US006702550B2

(12) United States Patent
Darkins, Jr. et al.

(10) Patent No.: US 6,702,550 B2
(45) Date of Patent: Mar. 9, 2004

(54) TURBINE SHROUD SEGMENT AND SHROUD ASSEMBLY

(75) Inventors: Toby George Darkins, Jr., Loveland, OH (US); Mary Ellen Alford, Cincinnati, OH (US); Christopher Charles Glynn, Hamilton, OH (US)

(73) Assignee: General Electric Company, Schenectady, NY (US)

( * ) Notice: Subject to any disclaimer, the term of this patent is extended or adjusted under 35 U.S.C. 154(b) by 165 days.

(21) Appl. No.: 10/050,451

(22) Filed: Jan. 16, 2002

(65) Prior Publication Data

US 2003/0133790 A1 Jul. 17, 2003

(51) Int. Cl.[7] ..... F01D 11/08

(52) U.S. Cl. ..... 415/139; 415/116; 415/173.1; 415/200

(58) Field of Search ..... 415/115, 116, 415/138, 139, 173.1, 173.4, 173.5, 200

(56) References Cited

U.S. PATENT DOCUMENTS

| | | | | |
|---|---|---|---|---|
| 5,071,313 A | | 12/1991 | Nichols | |
| 5,074,748 A | | 12/1991 | Hagle | |
| 5,127,793 A | | 7/1992 | Walker et al. | |
| 5,562,408 A | | 10/1996 | Proctor et al. | |
| 6,315,519 B1 | * | 11/2001 | Bagepalli et al. | 415/139 |
| 6,435,824 B1 | * | 8/2002 | Schell et al. | 415/200 |

* cited by examiner

*Primary Examiner*—Christopher Verdier
(74) *Attorney, Agent, or Firm*—Nathan D. Herkamp; Lee H. Sachs

(57) ABSTRACT

A turbine engine shroud segment, preferably a low ductility material, for example a ceramic matrix composite, comprises a segment body extending between body circumferential ends. The body includes a body radially inner surface arcuate at least circumferentially, and a body radially outer surface from which a plurality of hooks extend generally radially outwardly. Each hook comprises a generally radially outwardly extending hook arm with a generally axially extending hook end having a generally radially inner surface in spaced apart juxtaposition with a portion of the body radially outer surface. Such body outer surface includes at least two body contact surfaces each matched in shape and in juxtaposition at least at body circumferential ends with a cooperating hanger contact surface. The radially inner surface of each hook end includes a hook end contact surface matched in shape with a cooperating hanger contact surface at least in a circumferential middle portion of such surface. In a turbine engine shroud assembly, a plurality of such shroud segments are assembled circumferentially with a shroud hanger including at least one hanger foot assembled within and between the segment hooks. The hanger foot includes a plurality of spaced apart hanger foot contact surfaces cooperating in juxtaposition with the contact surfaces of the shroud segment body radially outer surface and the hook end radially inner surfaces. The various contact surfaces cooperating in juxtaposition are matched in shape each to define a fluid choke therebetween.

20 Claims, 4 Drawing Sheets

TURBINE SHROUD SEGMENT AND SHROUD ASSEMBLY

The Government has rights in this invention pursuant to Contract No. F33615-97-C-2778 awarded by the Department of Air Force.

BACKGROUND OF THE INVENTION

This invention relates generally to turbine engine shroud segments and shroud segment assemblies including a surface exposed to elevated temperature engine gas flow. More particularly, it relates to air cooled gas turbine engine shroud segments, for example used in the turbine section of a gas turbine engine, and made of a low ductility material.

A plurality of gas turbine engine stationary shroud segments assembled circumferentially about an axial flow engine axis and radially outwardly about rotating blading members, for example about turbine blades, defines a part of the radial outer flowpath boundary over the blades. As has been described in various forms in the gas turbine engine art, it is desirable to maintain the operating clearance between the tips of the rotating blades and the cooperating, juxtaposed surface of the stationary shroud segments as close as possible to enhance engine operating efficiency. Typical examples of U.S. Patents relating to turbine engine shrouds and such shroud clearance include U.S. Pat. No. 5,071,313—Nichols; U.S. Pat. No. 5,074,748—Hagle; U.S. Pat. No. 5,127,793—Walker et al.; and U.S. Pat. No. 5,562,408—Proctor et al.

In its function as a flowpath component, the shroud segment and assembly must be capable of meeting the design life requirements selected for use in a designed engine operating temperature and pressure environment. To enable current materials to operate effectively as a shroud in the strenuous temperature and pressure conditions as exist in the turbine section flowpath of modem gas turbine engines, it has been a practice to provide cooling air to a radially outer portion of the shroud. However as is well known in the art, for example as described in some of the above identified patents, provision of such cooling air is at the expense of engine efficiency. Therefore, it is desired to conserve use of cooling air by minimizing leakage into the flowpath of the engine of cooling air not designed in the engine. For example, some forms of shroud segments include therethrough cooling passages intentionally to pass cooling air into the engine flow stream. However, cooling air leakage about edges of a shroud segment can reduce designed efficiency by wasting cooling airflow.

It has been observed that one source of such segment edge leakage can result from shroud segment deformation such as deflection or distortion, generally referred to as "chording". Chording results from a thermal differential or gradient between a higher temperature radially inner shroud surface and a lower temperature, air cooled shroud outer shroud surface. At least the radially inner or flowpath surface of a shroud and its segments are arced circumferentially to define a flowpath annular surface about the rotating tips of the blades. The thermal gradient between the inner and outer faces of the shroud, resulting from cooling air impingement on the outer surface, causes the arc of the shroud segments to chord or tend to straighter out circumferentially. As a result of chording, the circumferential end portions of the inner surface of the shroud segment tend to move radially outwardly in respect to the middle portion of the segment. If allowed to occur, this type of action can increase the clearance between adjacent shroud segments, generally resulting in a wedge shaped gap or space between adjacent segments. Therefore, for more efficient engine operation, it is desirable to restrain chording or seal the gap resulting from chording. As is well known in the gas turbine engine art, other segment distortion or distortion forces can occur, for example in a high pressure turbine. Such forces are generated by pressure differences acting on a shroud segment as a result of a relatively high cooling air pressure on a radially outer portion of a shroud segment, opposite a lower flow stream pressure which reduces further passing downstream through a turbine.

Metallic type materials currently and typically used as shrouds and shroud segments have mechanical properties including strength and ductility sufficiently high to enable the shrouds to be restrained against such deflection or distortion resulting from thermal gradients and other pressure forces. Examples of such restraint include the well known side rail type of structure, or the C-clip type of sealing structure, for example described in the above identified Walker et al patent. That kind of restraint and sealing results in application of a compressive force at least to one end of the shroud to inhibit chording or other distortion.

Current gas turbine engine development has suggested, for use in higher temperature applications such as shroud segments and other components, certain materials having a higher temperature capability than the metallic type materials currently in use. However such materials, forms of which are referred to commercially as a ceramic matrix composite (CMC), have mechanical properties that must be considered during design and application of an article such as a shroud segment. For example, as discussed below, CMC type materials have relatively low tensile ductility or low strain to failure when compared with metallic materials. Also, CMC type materials have a coefficient of thermal expansion (CTE) in the range of about 1.5–5 microinch/inch/° F., significantly different from commercial metal alloys used as restraining supports or hangers for shrouds of CMC type materials. Such metal alloys typically have a CTE in the range of about 7–10 microinch/inch/° F. Therefore, if a CMC type of shroud segment is restrained and cooled on one surface during operation, forces can be developed in CMC type segment sufficient to cause failure of the segment.

Generally, commercially available CMC materials include a ceramic type fiber, for example SiC, forms of which are coated with a compliant material such as BN. The fibers are carried in a ceramic type matrix, one form of which is SiC. Typically, CMC type materials have a room temperature tensile ductility of no greater than about 1%, herein used to define and mean a low tensile ductility material. Generally CMC type materials have a room temperature tensile ductility in the range of about 0.4–0.7%. This is compared with metallic shroud and/or supporting structure or hanger materials having a room temperature tensile ductility of at least about 5%, for example in the range of about 5–15%. Shroud segments made from CMC type materials, although having certain higher temperature capabilities than those of a metallic type material, cannot tolerate the above described and currently used type of compressive force or similar restraint force against chording. Neither can they withstand a stress rising type of feature, for example one provided at a relatively small bent or filleted surface area, without sustaining damage or fracture typically experienced by ceramic type materials. Furthermore, manufacture of articles from CMC materials limits the bending of the SiC fibers about such a relatively tight fillet to avoid fracture of the relatively brittle ceramic type fibers in the ceramic matrix. Provision of a shroud segment of such a low ductility material, particularly in combination or assembly with a shroud support or hanger that does not restrain the segment from chording, while avoiding undesirable leakage between adjacent shroud segments, would enable advantageous use of the higher temperature capability of CMC material for that purpose.

BRIEF SUMMARY OF THE INVENTION

Forms of the present invention provide a turbine engine shroud segment for mounting in a shroud assembly with a shroud hanger at a plurality of hanger contact surfaces. The segment comprises a shroud segment body extending for a circumferential segment length between circumferentially spaced apart shroud segment body first and second circumferential ends. The shroud segment includes a shroud segment body radially inner surface arcuate at least in a circumferential direction, and a shroud segment body generally radially outer surface. In addition, the shroud segment includes a plurality of substantially axially spaced apart shroud segment hooks integral with and extending generally radially outwardly from the shroud segment body radially outer surface. The segment comprises a plurality of spaced apart segment contact surfaces, each matched in shape with spaced apart cooperating hanger contact surfaces. Each hook comprises a generally radially outwardly extending hook arm having a hook arm generally axially inner surface and a generally axially extending hook end having a hook end generally inner surface in spaced apart juxtaposition with a portion of the shroud body generally radial outer surface. The shroud segment body radially outer surface includes at least two shroud segment body contact surfaces each matched in shape, and in juxtaposition with a cooperating hanger contact surface at least at the shroud segment body first and second ends. Also, each hook end radially inner surface includes a hook end contact surface matched in shape with a cooperating hanger contact surface at least in a circumferential middle portion of the hook end radially inner surface.

Another form of the present invention provides a turbine engine shroud assembly comprising a plurality of the shroud segments described above assembled circumferentially to define a segmented turbine engine shroud. The assembly includes a shroud hanger comprising at least one shroud segment hanger foot assembled within and between the shroud segment hooks. The hanger foot includes a plurality of spaced apart hanger foot contact surfaces each of a shape, cooperating in juxtaposition with the shroud segment contact surfaces of the shroud segment body radially outer surface and the hook end radially inner surface. The contact surfaces of the shroud segment and the contact surfaces of the hanger foot cooperate in juxtaposition and are matched one with another to define therebetween a fluid choke.

DETAILED DESCRIPTION OF THE INVENTION

The present invention will be described in connection with an axial flow gas turbine engine for example of the general type shown and described in the above identified Proctor et al patent. Such an engine comprises, in serial flow communication generally from forward to aft, one or more compressors, a combustion section, and one or more turbine sections disposed axisymmetrically about a longitudinal engine axis. Accordingly, as used herein, phrases using the term "axially", for example "axially forward" and "axially aft", are directions of relative positions in respect to the engine axis; phrases using forms of the term "circumferential" refer to circumferential disposition generally about the engine axis; and phrases using forms of the term "radial", for example "radially inner" and "radially outer", refer to relative radial disposition generally from the engine axis.

Figure 1:
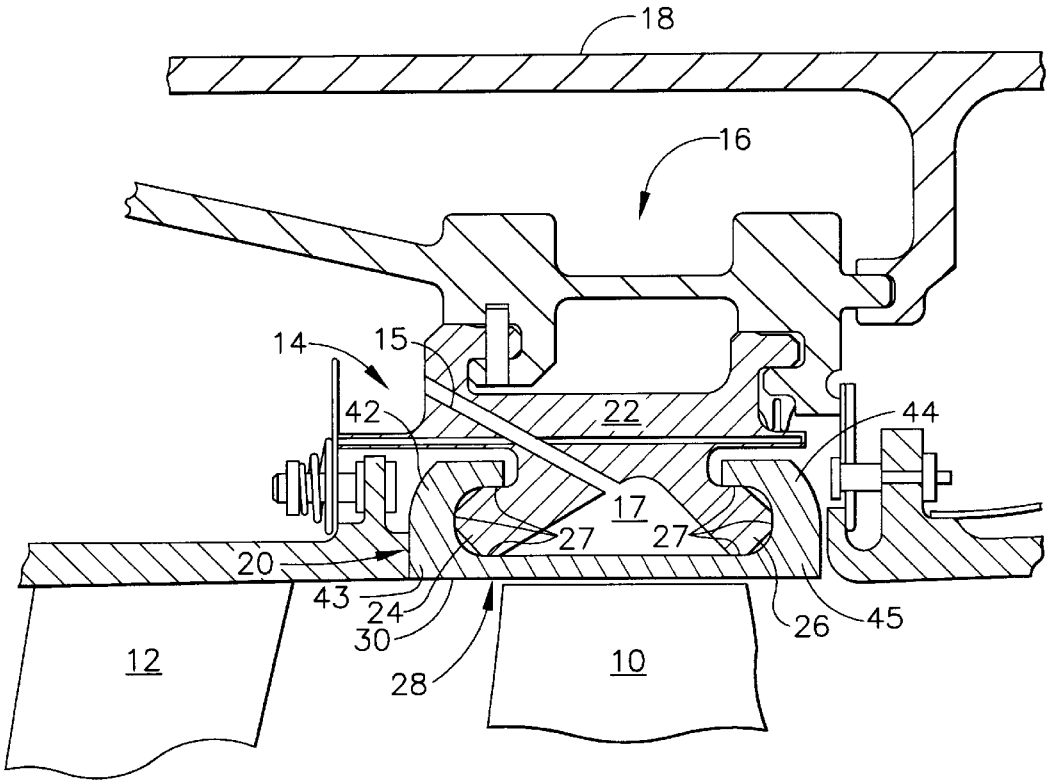
FIG. 1 is a fragmentary, diagrammatic, partially sectional axial view through a portion of a turbine engine shroud disposed axisymmetrically about a stage of turbine rotor blades and adjacent a stage of stationary turbine vanes.

The fragmentary, diagrammatic, partially sectional view of FIG. 1 shows a portion of a gas turbine engine turbine section including at least one stage of rotating turbine blades 10 in serial flow relationship axially aft or downstream of a stage of stationary turbine vanes 12. Circumferentially disposed about and radially outward from rotating blades 10 is a stationary shroud assembly shown generally at 14 in FIG. 1. Assembly 14 is shown in more detail in the diagrammatic, fragmentary, partially sectional view of FIG. 2. Shroud assembly 14 is carried by a typical shroud support structure, shown generally at 16, from an outer frame 18. Typically cooling air is provided through conduit 15 within shroud support structure 16 to cavity 17 within shroud assembly 14. In the embodiment of FIG. 1, such cooling air is designed to pass through cooling holes or passages (not shown) through the shroud segment shown generally at 20. It is desired to avoid other flow of such cooling air from cavity 17.

Shroud assembly 14 comprises a plurality of shroud segments 20 circumferentially disposed about and radially outwardly from the stage of turbine blades 10. Shroud segments 20 are carried by a shroud segment hanger 22. In the embodiment of the drawings, shroud segment hanger 22 includes a pair of generally axially disposed spaced apart hanger feet, axially forward foot 24 and axially aft foot 26. As was stated above, it was desirable to avoid flow of cooling air out of cavity 17 about hanger feet 24 and 26. According to a form of the present invention, a series of spaced apart air flow choke, constriction portions are provided between shroud segment 22, for example hanger feet 24 and 26 at hanger contact surfaces 27, and inner surfaces of shroud segment 20 at shroud contact surfaces 29. Such chokes or constrictions function similarly to a labyrinth type of seal between such juxtaposed, cooperating surfaces.

Figure 2:
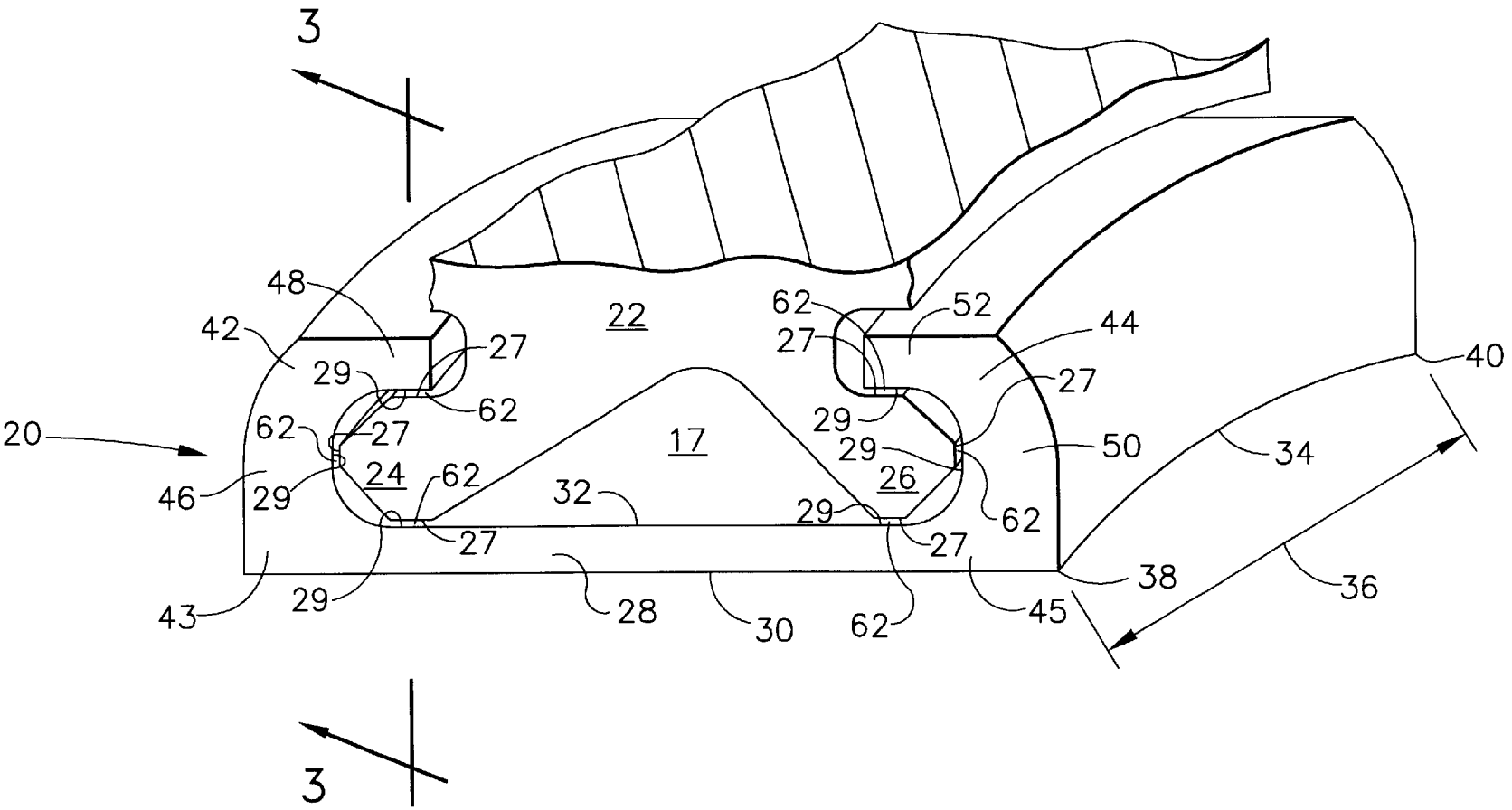
FIG. 2 is a fragmentary, diagrammatic partially sectional perspective view of the assembly of a shroud segment with a portion of a shroud hanger.

Shroud segment 20 comprises a shroud segment body 28 having a radially inner surface 30, within and defining a portion of the engine flowpath in juxtaposition with the turbine blades 10, and a radially outer surface 32 over which cooling air in cavity 17 typically is flowed. In the embodiment of FIGS. 1 and 2, each shroud segment 20 has a hanger 22 and each cavity 17 is a closed cavity, substantially not communicating between adjacent hangers and shroud segments.

As shown more clearly in FIG. 2 at 34, shroud body radially inner surface 30 is shaped in an arc circumferentially for the circumferential segment length 36 between shroud body first circumferential end 40 and shroud body second circumferential end 38 to enable the plurality of shroud segments to be assembled as an annulus circumferentially about the stage of turbine blades 10. In the embodiment of the drawings, shroud segment 20 further comprises a pair of axially spaced apart shroud segment hooks: axially forward hook 42 integral with and extending generally radially from shroud body outer surface 32 substantially at axially forward end 43 of shroud body 28, and axially aft hook 44 integral with and extending generally radially from shroud body outer surface 32 substantially at axially aft end 45 of shroud body 28, as shown in FIGS. 1 and 2. Hook 42 includes a generally radially extending hook arm 46 and a generally axially aft extending hook end 48. Similarly, hook 44 includes a generally radially extending hook arm 50 and a generally axially forward extending hook end 52.

As was described above, during engine operation with hot flowpath gas affecting shroud segment body inner surface 30 and cooling air affecting the radially outer portions of shroud assembly 14, there is a tendency for shroud segments to chord circumferentially, as described above. According to forms of the present invention, such chording is not restrained from occurring because of mechanical properties of the low ductility material used to make the shroud segment. However, the present invention accommodates such chording to avoid undesired cooling air leakage about edge portion of the shroud segment.

Figure 3:
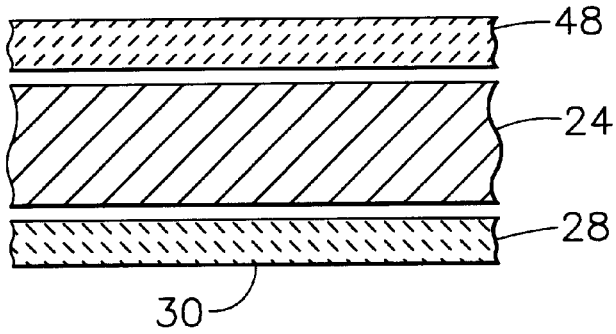
FIG. 3 is sectional view taken along lines 3—3 of FIG. 2.
Figure 4:
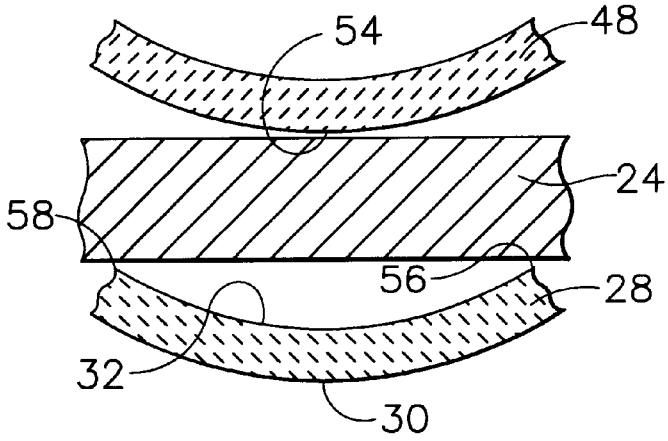
FIG. 4 is a view of FIG. 3 showing the potential thermal induced chording tendencies of portions of the shroud segment.

The sectional, diagrammatic views of FIGS. 3 and 4, depicting sections along lines 3—3 of FIG. 2, show respectively the shroud segment before engine operation and the circumferential thermally induced chording during engine operation, shown in FIG. 4. As shown in FIG. 4, if a known shroud is allowed to chord, the shroud chording can result in a radially outer pressure or contact line or point 54 in a circumferentially middle portion between end 48 of hook 42 and axially forward foot 24 of shroud hanger 22, and radially inner pressure or contact lines or points 56 and 58 spaced apart at circumferential end portions between shroud segment body radially outer surface 32 and axially forward foot 24. Similar contacts are generated between portions of hook 44 and aft hanger foot 26. It has been recognized in connection with evaluation of forms of the present invention that generation of such chording deflections from chording of shroud segments made of a low ductility material as a CMC can result in cracking or failure of the CMC shroud segment as a result of engine operation.

According to forms of the present invention, a plurality of spaced apart, shape matched fluid or air cooling constriction surfaces defining a series of at least two fluid flow choke portions are provided about each hanger foot, between a hanger foot surface and a surface of the shroud segment. Such cooperating, juxtaposed surfaces are matched in shape one with another in a manner that avoids a stress riser or sharp fillet configuration in a low ductility material. As used herein, phrases relating to matched shapes of such juxtaposed surfaces cooperating in a fluid restricting relationship preferably mean substantially planar surfaces, but also include generally arcuate shapes, including circular or otherwise curved to a degree less than that creating a stress riser condition in a low ductility material. Matched shapes specifically excludes substantially "V" shaped or narrow, sharply filleted surfaces, for example of the type shown in the above identified patents relating to current turbine shrouds and their supporting structure; and that, during manufacture of a ceramic type fiber reinforced low ductility material, would result in fracture of such fiber during lay-up and bending. Such series of constrictions or choke surfaces about each hanger foot function similarly to a labyrinth seal in restricting fluid flow thereabout.

Figure 5:
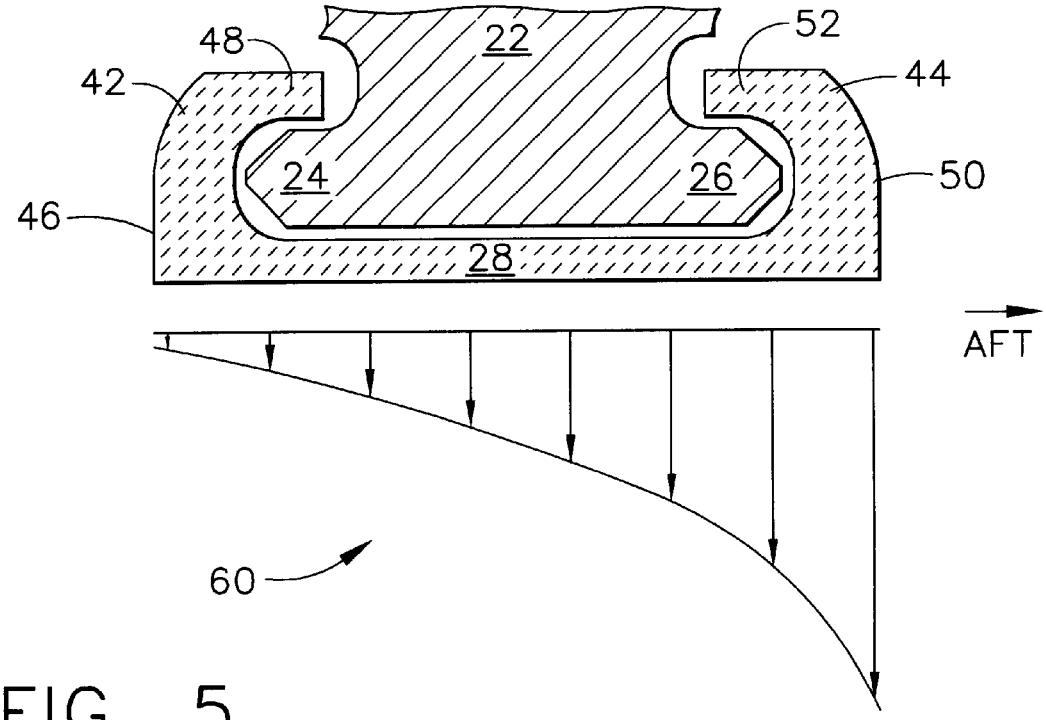
FIG. 5 is a fragmentary diagrammatic view generally as in FIGS. 1 and 2 including an axial static pressure profile as work is extracted by turbine blades through a turbine engine.
Figure 6:
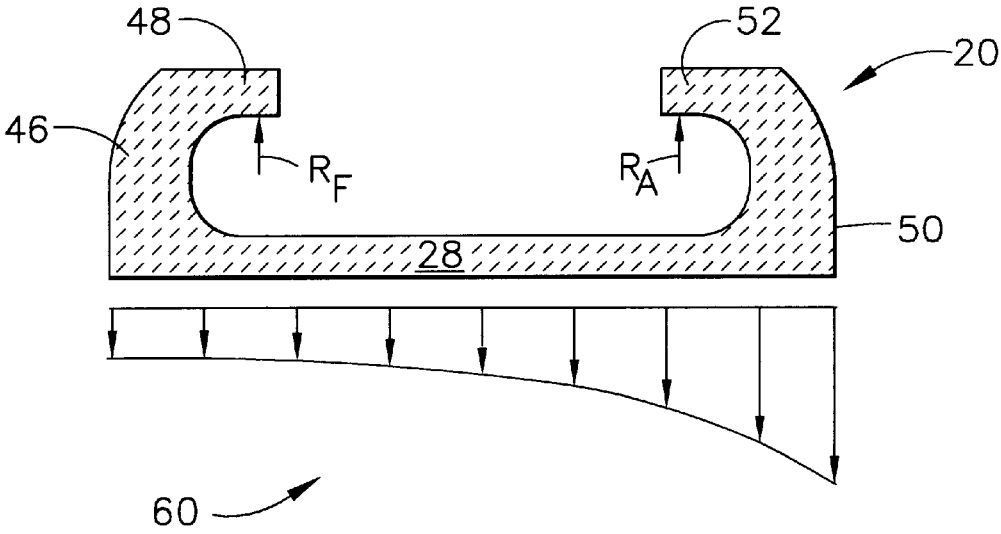
FIG. 6 is a diagram of the static pressure profile as in FIG. 5 and the resulting forces acting on the hook ends of the shroud segment shown in FIGS. 1, 2, and 5.

Another feature of a preferred embodiment of the present invention is shown in FIGS. 1 and 2, and more particularly in the fragmentary, diagrammatic view of FIG. 5, in the shape of the shroud segments. That feature is the relative positioning and direction of the shroud segment hooks 42 and 44, and their respective hook arms 46 and 50 and hook ends 48 and 52. In that preferred embodiment, as described above, hook 42 and its hook arm 46 and hook end 48 are spaced apart axially forward of hook 44 and its hook arm 50 and hook end 52. In addition, hook end 48 extends axially aft from radial hook arm 46, and hook end 52 extends axially forward from radial hook arm 50. That combination of relative positioning and extension is provided, according to a preferred form of the present invention, to compensate for and reduce additional shroud segment distortion, other than that related to thermally induced chording. Such additional distortion can result from the relative axial static pressure change, shown generally at 60 in the diagram of FIG. 5, downstream through a gas turbine engine. That additional pressure and the resulting additional segment distortion, can result from different gas or cooling airflow pressure creating a counteracting moment to bend and reduce the effective span of the shroud segment away from the engine gas flowpath. For example, the cooling air pressure in cavity 17, shown in FIG. 1, to enable flow of cooling air through channels (not shown) through shroud segment body 28 and into the engine gas flowpath adjacent turbine blade 10, must be greater than the flow path gas static pressure at blade 10. That pressure differential axially inward generates a force on the shroud segment tending to distort the shroud segment body axially toward blade 10. At the same time, such force on the shroud segment body creates a generally radially outward directed force on shroud segment hook ends 48 and 52. Such force, represented in the diagram of FIG. 6 by arrows $R_F$ and $R_A$, is greater on axially aft hook end 52 because of the shown engine gas flow decreasing pressure downstream through the engine, and consequent increasing pressure differential across the shroud segment. The positioning of the axially extending shroud segment hook end 48 substantially aft of forward end 43 of shroud segment body 28, and shroud segment hook end 52 substantially forward of axially aft end 45 of shroud segment body 28, as shown in FIGS. 1 and 2, yields a counteracting mechanical deflection on shroud segment body 28. Such positioning in combination with the above described cooperating, juxtaposed contact surfaces defining a series of fluid flow chokes about a shroud hanger reduces a plurality of potentially distorting forces on a turbine engine shroud segment. Embodiments of the present invention not only allow chording of a shroud segment made of a low ductility material, but also compensate for other distortion of the segment resulting from air and/or gas pressure differentials acting on the shroud segment.

During manufacture of shroud segment 20 and hanger feet 24 and 26, the relative operating distortions and the relative coefficients of thermal expansion of the materials are considered. The dimensions of juxtaposed surfaces about hanger feet 24 and 26 and shroud segment 20 are selected to provide fluid/airflow chokes or constrictions 62, FIG. 2, therebetween sufficiently wide to allow assembly of the members prior to engine operation. However, they are selected to enable such restrictions to narrow and preferably to close during engine operation. Thus the assembly of members are closely coupled dimensionally.

As was mentioned above, for use in connection with this invention a low ductility material is one having a room temperature tensile ductility of no greater than about 1%. CMC type materials such as the commercially available SiC fiber/SiC matrix type CMC typically have a room temperature tensile ductility in the range of about 0.4–0.7%.

Because forms of the present invention allow chording to occur in shroud segments made of a low ductility material, another feature and distinction of the present invention for use with a low ductility material is maintaining a relatively small allowable circumferential shroud segment length, show at 36 in FIG. 2. Maintaining a short length compared with known shroud segments minimizes the effect of chording and reduces the capability for cooling air leakage about circumferential edges of the shroud segment. The amount or degree of circumferential chording of a shroud segment depends, at least in part, upon such features as the thermal gradient generated within the material, the thickness of the segment, the length of the segment, and external pressures applied to the segment.

One measure of embodiments of the present invention is a comparison of the number of shroud segments of the present invention in a shroud assembly with the number of adjacent stationary vanes in a turbine engine. It has been observed to enable practice of forms of this invention that such circumferential length of a low ductility shroud segment must be significantly less than the length of shroud segments of the described stronger materials currently in use. The number of currently used shroud segments in a turbine assembly with adjacent turbine vanes is no more than and generally less than the number of such adjacent vanes. According to embodiments of the present invention, the number of low ductility turbine shroud segments that are allowed to chord during engine operation is significantly greater, for example at least about two or three times the number of adjacent vanes.

In the design of a turbine engine shroud for use about rotating blading members, as described above, it is desirable to have as few as possible shroud segments in the shroud to avoid cooling air leakage from between segments into the flowpath of the engine. Thus, in known, current designs, a shroud segment is sufficiently long circumferentially to span at least one and generally several adjacent stationary vanes. For example, in a currently commercial and typical gas turbine engine identified as a CFM-56-7 gas turbine engine, the number of high pressure turbine shroud segments, made of a commercially available Rene' N5 Ni base superalloy in a shroud assembly is 42 adjacent a stage of 42 stationary vanes. In other typical current combinations, the number of high temperature metal alloy shroud segments is less than the number of adjacent vanes. In the evaluation of the present invention, for the type and size of gas turbine engines currently available, a shroud segment of a low ductility material according to embodiments of the present invention allowing the segment to chord during engine operation has a circumferential length of up to about 2 inches. A circumferential length of greater than about 2 inches can result in excessive leakage of the type discussed above and/or stresses on the low ductility material sufficient to cause cracking or failure of the shroud segment.

It has been recognized, according to embodiments of the present invention, that the number of shroud segments made of a low ductility material, for example of the CMC type, is significantly greater than the number of adjacent stationary turbine vanes, for example at least about twice as many. Further, it has been observed in forms of the present invention related to current types and sizes of gas turbine engines that generally the circumferential length of such a segment should be no greater than about 2 inches. This is the opposite of the design of current should segments, the goal of which is to have a circumferential length as great as possible, ideally one piece fully circumferentially about the rotating turbine blades to avoid leakage of cooling air between shroud segments.

The present invention has been described in connection with specific examples, materials and combinations of materials and structures. However, it should be understood that they are intended to be typical of rather than in any way limiting on the scope of the invention. Those skilled in the various arts involved, for example relating to turbine engines, to high temperature ceramic and/or metallic materials, and their combination, will understand that the invention is capable of variations and modifications without departing from the scope of the appended claims.

What is claimed is:

1. A turbine engine shroud segment for mounting in a shroud assembly with a shroud hanger at a plurality of hanger contact surfaces, the segment comprising a shroud segment body extending for a circumferential segment length between circumferentially spaced apart shroud segment body first and second circumferential ends; the shroud segment body including a shroud segment body radially inner surface arcuate at least circumferentially, and a shroud segment body generally radially outer surface; and a plurality of substantially axially spaced apart shroud segment hooks integral with and extending generally radially outwardly from the shroud segment body radially outer surface; wherein:

the shroud segment comprises a plurality of spaced apart segment contact surfaces each matched in shape with spaced apart cooperating hanger contact surfaces;

each hook comprises a generally radially outwardly extending hook arm having a hook arm generally axially inner surface and a generally axially extending hook end having a hook end generally radially inner surface in spaced apart juxtaposition with a portion of the shroud body generally radial outer surface;

the shroud segment body radially outer surface including at least two shroud segment body contact surfaces each matched in shape and in juxtaposition at least at the shroud segment body first and second ends, with a cooperating hanger contact surface;

the radially inner surface of each hook end including a hook end contact surface matched in shape with a cooperating hanger contact surface at least in a circumferential middle portion of the hook end radially inner surface; and, the hanger contact surfaces and the segment contact surfaces are substantially planar.

2. The shroud segment of claim 1 in which the shroud segment is made of a low ductility material having a low tensile ductility, measured at room temperature to be no greater than about 1%.

3. The shroud segment of claim 2 in which the circumferential segment length is no greater than about 2 inches.

4. The shroud segment of claim 2 in which the low ductility material is a ceramic matrix composite having a room temperature tensile ductility no greater than about 0.7%.

5. The shroud segment of claim 1 in which each hook arm axially inner surface includes a hook arm contact surface matched in shape with a cooperating hanger contact surface.

6. The shroud segment of claim 5 in which the hook arm contact surface and the cooperating hanger contact surface are substantially planar.

7. The shroud segment of claim 1 in which the plurality of axially spaced apart shroud segment hooks comprise:

a first axially forward hook disposed substantially at an axially forward end of the shroud segment body and in which the first hook end is disposed and the first hook arm generally axially inner surface faces generally axially aft; and, a second axially aft hook disposed substantially at an axially aft end of the segment body and in which the second hook end is disposed and the second hook arm generally axially inner surface faces generally axially forward.

8. The shroud segment of claim 2 in which:

the shroud segment body radially inner surface is designed to operate at a first temperature, and the shroud segment body radially outer surface is designed to operate at a second temperature less than the first temperature to define a thermal gradient within the shroud segment body; and, the circumferential segment length is no greater than about 2 inches.

9. A turbine engine shroud assembly comprising:

a plurality of the turbine engine shroud segments of claim 1 assembled circumferentially to define a segmented turbine engine shroud; and, the shroud hanger comprising at least one shroud segment hanger foot assembled within and between the shroud segment hooks;

the hanger foot including a plurality of spaced apart hanger foot contact surfaces each of a shape, the hanger foot contact surfaces cooperating in juxtaposition with the shroud segment contact surfaces of the shroud segment body radially outer surface and the hook end radially inner surfaces, the contact surfaces of the shroud segment and the contact surfaces of the hanger foot, cooperating in juxtaposition one with another, being matched in shape each to define therebetween a fluid choke.

10. The shroud assembly of claim 9 in which there is a shroud hanger for each of the plurality of shroud segments.

11. The shroud assembly of claim 9 in which the hanger foot contact surfaces and the shroud segment contact surfaces substantially are planar.

12. The shroud assembly of claim 9 in which:

each shroud hook arm generally axial inner surface includes hook arm contact surfaces; and, the hanger foot includes hanger foot contact surfaces cooperating in juxtaposition and matched in shape with the hook arm contact surfaces to define therebetween a fluid choke.

13. The shroud assembly of claim 12 in which the hanger foot contact surfaces and the hook arm contact surfaces substantially are planar.

14. The shroud assembly of claim 9 in which the shroud segments are made of a low ductility material having a low tensile ductility, measured at room temperature to be no greater than about 1%.

15. The shroud assembly of claim 14 in which the circumferential segment length is no greater than about 2 inches.

16. The shroud assembly of claim 9 in which the plurality of axially spaced apart shroud segment hooks comprise:

a first axially forward hook disposed substantially at an axially forward end of the shroud segment body and in which the first hook end is disposed and the first hook arm generally axially inner surface faces generally axially aft; and, a second axially aft hook disposed substantially at an axially aft end of the shroud segment and in which the second hook end is disposed and the second hook arm generally axially inner surface faces generally axially forward.

17. The shroud assembly of claim 16 in which the hanger foot comprises:

a generally axially forward extending first foot portion and a generally axially aft extending second foot portion;

the first foot portion including a plurality of spaced apart first foot portion contact surfaces each of a shape, the first foot contact portions cooperating in juxtaposition with contact surfaces of the first hook end and of the shroud segment body radially outer surface; and, the second foot portion including a plurality of spaced apart second foot portion contact surfaces each of a shape, the second foot contact portions cooperating in juxtaposition with contact surfaces of the second hook end and of the shroud segment body radially outer surface;

the respective contact surfaces of each foot portion and the contact surfaces of the shroud segment in juxtaposition therewith being matched in shape and defining therebetween a fluid choke.

18. The shroud assembly of claim 17 in which the contact surfaces are substantially planar.

19. The shroud assembly of claim 9 disposed in a turbine engine axially adjacent a turbine engine stationary vane assembly including a first number of generally radially extending stationary vanes assembled spaced apart circumferentially about an engine axis, wherein the plurality of turbine engine shroud segments is a second number greater than the first number.

20. The assembly of claim 19 in which the second number is at least twice the first number.

* * * * *